US012616883B2

(12) United States Patent
Pacha

(10) Patent No.: US 12,616,883 B2
(45) **Date of Patent: *May 5, 2026**

(54) GOLF BAGS, GOLF BAG TOPS AND METHODS TO MANUFACTURE GOLF BAGS AND GOLF BAG TOPS

(71) Applicant: PARSONS XTREME GOLF, LLC, Scottsdale, AZ (US)

(72) Inventor: Duane E. Pacha, Chandler, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 360 days.

This patent is subject to a terminal disclaimer.

(21) Appl. No.: 18/375,625

(22) Filed: Oct. 2, 2023

(65) Prior Publication Data

US 2024/0033593 A1 Feb. 1, 2024

Related U.S. Application Data

(63) Continuation of application No. 17/348,991, filed on Jun. 16, 2021, now Pat. No. 11,806,593, which is a continuation of application No. 16/216,736, filed on Dec. 11, 2018, now Pat. No. 11,065,516.

(60) Provisional application No. 62/607,387, filed on Dec. 19, 2017.

(51) Int. Cl.
*A63B 55/40* (2015.01)

(52) U.S. Cl.
CPC ..... *A63B 55/40* (2015.10); *A63B 2209/08* (2013.01)

(58) Field of Classification Search
CPC ..... A63B 55/40; A63B 2269/08
USPC ..... 206/315.6
See application file for complete search history.

(56) References Cited

U.S. PATENT DOCUMENTS

| | | | |
|---|---|---|---|
| 4,881,638 | A | 11/1989 | Cho |
| 5,176,253 | A | 1/1993 | Perrin et al. |
| 5,366,075 | A | 11/1994 | Dwight |
| 5,860,520 | A | 1/1999 | Tang |
| 5,964,346 | A | 10/1999 | O'connor |
| 6,375,004 | B1 | 4/2002 | Tuerschmann et al. |
| 6,877,604 | B2 | 4/2005 | Pratt et al. |
| D513,876 | S | 1/2006 | Solheim et al. |
| D513,877 | S | 1/2006 | Solheim et al. |
| D513,878 | S | 1/2006 | Anderson et al. |
| D520,752 | S | 5/2006 | Solheim et al. |
| D522,754 | S | 6/2006 | Anderson |
| D530,922 | S | 10/2006 | Anderson |
| 7,124,886 | B2 | 10/2006 | Heidenreich |
| D538,042 | S | 3/2007 | Suggs |
| D544,210 | S | 6/2007 | McGuire et al. |

(Continued)

*Primary Examiner* — Sue A Weaver

(57) ABSTRACT

Exemplary embodiments of golf bags, golf bag tops, and methods to manufacture golf bags and golf bag tops are generally described herein. In one example, a golf bag may include a body portion having a top portion, a bottom portion, and a housing portion extending between the top portion and the bottom portion. A handle portion may be located at or proximate the top portion. A club fastener portion may be coupled to the handle portion and may have a U-shaped portion configured to receive a shaft portion of a golf club and retain the golf club in an upright or tilted position. A golf club head of the golf club may be positioned above the club fastener portion and a grip portion of the golf club may be positioned below the club fastener portion. Other embodiments may be described and claimed.

20 Claims, 5 Drawing Sheets

(56) References Cited

U.S. PATENT DOCUMENTS

| | | | | |
|---|---|---|---|---|
| D557,501 | S | 12/2007 | Suggs et al. | |
| D557,502 | S | 12/2007 | Quartarone et al. | |
| D577,916 | S | 10/2008 | Quartarone et al. | |
| D580,656 | S | 11/2008 | Quartarone et al. | |
| D613,063 | S | 4/2010 | Quartarone, III et al. | |
| D613,064 | S | 4/2010 | Quartarone, III et al. | |
| D613,065 | S | 4/2010 | McGuire et al. | |
| D613,066 | S | 4/2010 | McGuire et al. | |
| 7,905,349 | B2 | 3/2011 | Campbell | |
| D636,596 | S | 4/2011 | McGuire | |
| D649,353 | S | 11/2011 | Loudenslager et al. | |
| D649,354 | S | 11/2011 | Loudenslager et al. | |
| D649,355 | S | 11/2011 | Loudenslager et al. | |
| D649,356 | S | 11/2011 | Loudenslager et al. | |
| D669,266 | S | 10/2012 | Loudenslager et al. | |
| 8,752,798 | B2 | 6/2014 | Loudenslager | |
| D713,148 | S | 9/2014 | Bruce | |
| D715,055 | S | 10/2014 | Bruce et al. | |
| D718,534 | S | 12/2014 | Bruce | |
| 8,910,785 | B2 | 12/2014 | Loudenslager | |
| 9,421,608 | B2 | 8/2016 | Loudenslager et al. | |
| 11,065,516 | B2 * | 7/2021 | Pacha ..... | A63B 55/40 |
| 2003/0047472 | A1 | 3/2003 | Feeney | |
| 2008/0169210 | A1 | 7/2008 | Heidenreich | |
| 2010/0320106 | A1 | 12/2010 | McGuire | |
| 2012/0111747 | A1 | 5/2012 | Reimers | |
| 2017/0021241 | A1 | 1/2017 | Pelz | |
| 2022/0266104 | A1 | 8/2022 | Kirtley et al. | |

* cited by examiner

GOLF BAGS, GOLF BAG TOPS AND METHODS TO MANUFACTURE GOLF BAGS AND GOLF BAG TOPS

CROSS REFERENCE

This application is a continuation of U.S. patent application Ser. No. 17/348,991, filed Jun. 16, 2021, now U.S. Pat. No. 11,806,593, which is a continuation of application Ser. No. 16/216,736, filed Dec. 11, 2018, now U.S. Pat. No. 11,065,516, which claims the benefit of U.S. Provisional Application No. 62/607,387, filed Dec. 19, 2017. The disclosures of the referenced applications are incorporated herein by reference.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf bags, golf bag tops, and methods to manufacture golf bags and golf bag tops.

BACKGROUND

Golf bags may be used to carry golf clubs and accessories. Some golf bags may be tube-shaped to hold a set of golf clubs and include one or more pockets for holding balls, tees, gloves, rain gear, and other golf related equipment and accessories. The open top portion of a golf bag may be divided into a number of slots to allow an individual to organize and sort the golf clubs. Accordingly, an individual may organize his or her golf clubs based on the available slots provided by the open top portion of the golf bag.

Figure 1:
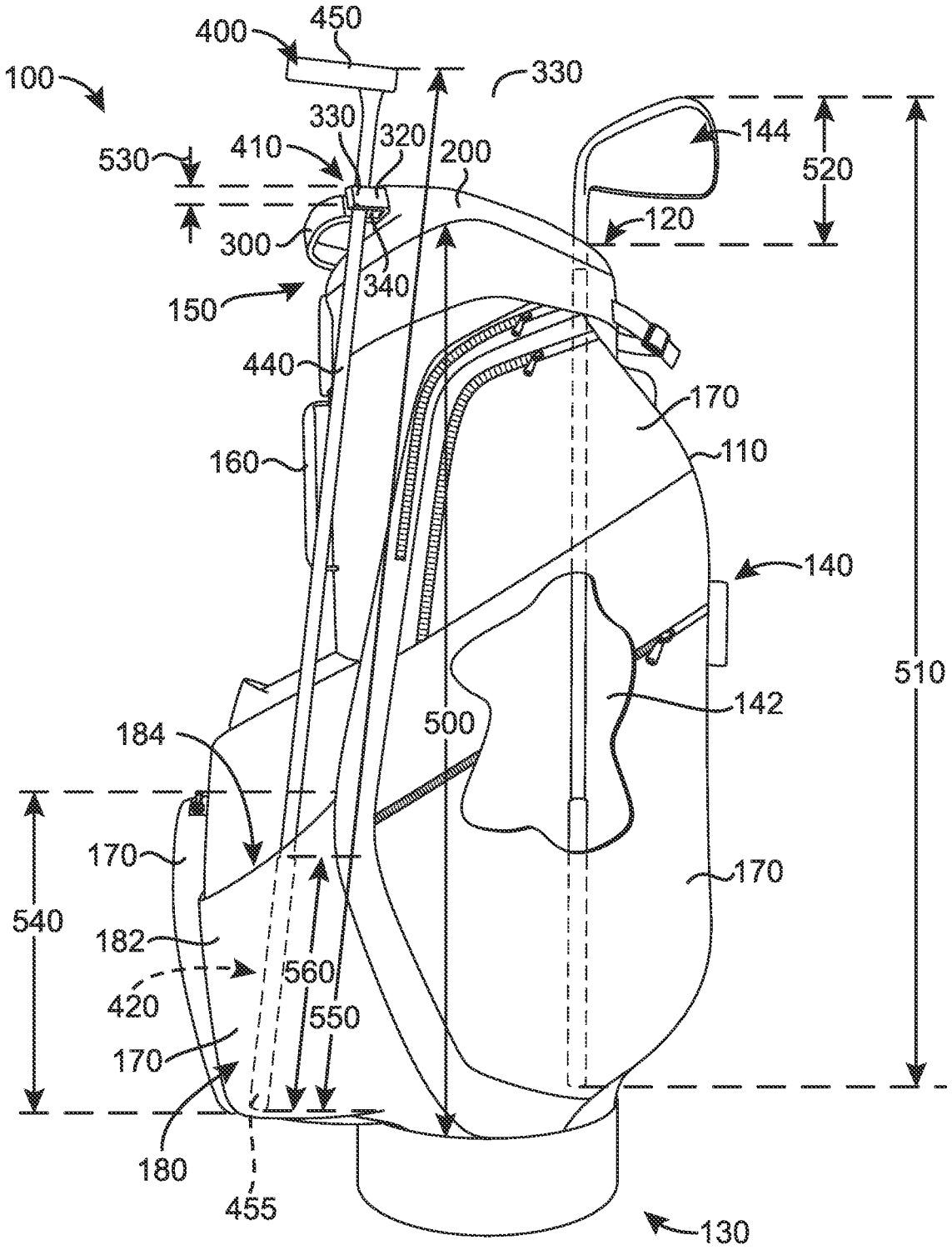
FIG. 1 depicts a golf bag with a golf bag top according to an exemplary embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

In general, golf bag tops and methods to manufacture golf bag tops are described herein. The apparatus, methods, and articles of manufacture described herein are not limited in this regard.

In the example of FIG. 1, a golf bag 100 may include a body portion 110 having a top portion 120, a bottom portion 130, a first housing portion 140 extending between the top portion 120 and the bottom portion 130, and a second housing portion 150 located outside of the first housing portion 140. The first housing portion 140 may define a chamber portion 142 for holding and maintaining one or more golf clubs (e.g., one generally shown as 144) inside the body portion 110. The golf club 144 may be any type of golf club such as, but not limited to, an iron-type golf club, a wood-type golf club, a hybrid-type golf club, or a putter-type golf club. Additionally, the golf club 144 may be part of a set of golf clubs. As described in detail below, the second housing portion 150 may enable one or more golf clubs (e.g., one generally shown as 400) to be prominently displayed and stored separately from any golf clubs stored in the first housing portion 140. The golf bag 100 may also include one or more strap portions (not shown) so that an individual can lift and/or carry the golf bag 100. The golf bag 100 may include one or more golf bag handles (e.g., one generally shown as 160) on the body portion 110 between the top portion 120 and the bottom portion 130. The golf bag 100 may also include one or more pockets (e.g., generally shown as 170) for carrying various items such as golf balls, golf tees, apparel, shoes, and/or other accessories. The pocket 170 may be accessible by different types of closures (e.g., zippers, Velcro®, buttons, etc.). The apparatus, methods, and articles of manufacture described herein are not limited in this regard.

Figure 2:
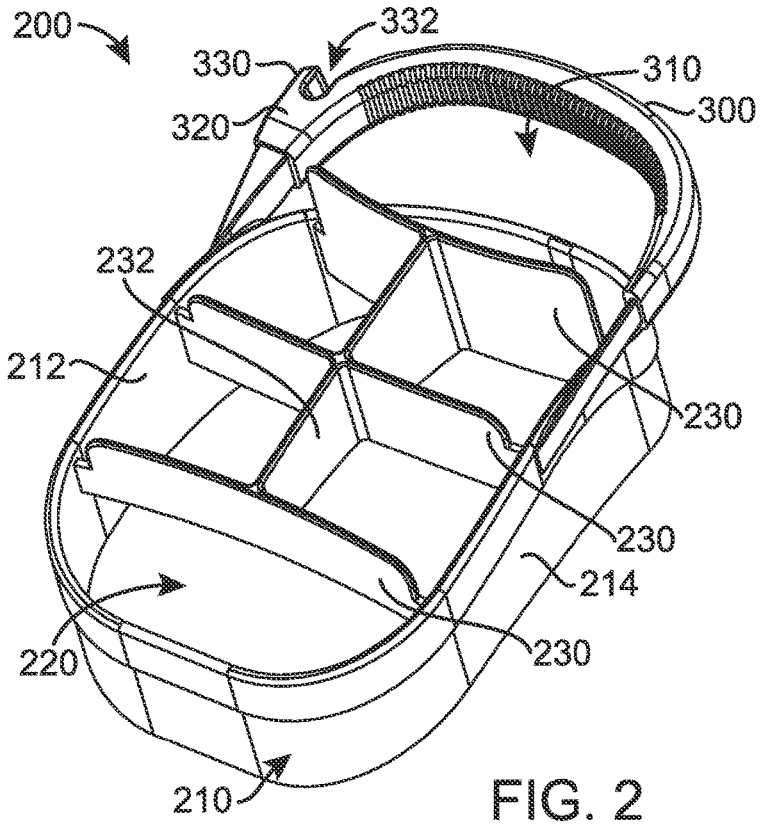
FIG. 2 depicts a top and side perspective view of a golf bag top according to an exemplary embodiment of the apparatus, methods, and articles of manufacture described herein.

In one example, as shown in FIGS. 1-9, the golf bag 100 may also include a golf bag top (e.g., described and shown as a club divider portion 200) located at or proximate to the top portion 120. The club divider portion 200 may have a shape, curvature, contour, and/or other physical characteristics as shown in the example of FIGS. 2-9 so as to fit on or inside the body portion 110 at or proximate to the top portion 120. The club divider portion 200 may include a divider body portion or a perimeter portion 210 having a first side 212 and a second side 214. As illustrated in FIG. 2, for example, the first side 212 and the second side 214 may correspond respectively to a left half and a right half of the perimeter portion 210. As shown in the example of FIGS. 2-9, the club divider portion 200 may include one or more interconnected rib portions 230 that may connect to the inner wall(s) of the perimeter portion 210 to define one or more openings 220, through which one or more golf clubs 144 can be inserted into the first housing portion 140 of the golf bag 100. While the figures may depict a particular number of rib portions 230, the apparatus, methods, and article of manufacture described herein may include more or less number of rib portions (e.g., one (1) rib portion or four (4) rib portions).

The rib portions 230 may each extend laterally between the first side 212 and the second side 214 and may be approximately parallel or nonparallel with each other. Additionally, the rib portions 230 may be interconnected by a spine portion 232 extending longitudinally between the first side 212 and the second side 214. Although the above example may include the spine portion 232, the apparatus, methods, and articles of manufacture described herein may not include the spine portion 232 to interconnect the rib portions 230. In one example, the club divider portion 200 may include six openings, through which one or more golf clubs 144 may be inserted into the first housing portion 140. While the above example may describe a particular number of openings defined by the rib portion(s) 230, the apparatus, methods, and article of manufacture described herein may include more or less openings (e.g., one (1) opening or eight (8) openings). By providing a plurality of openings 220, a set of golf clubs may be separated into different groups to allow an individual to organize the golf clubs in a certain manner. Alternatively, the club divider portion 200 may not include any rib portions 230 (e.g., a single opening to receive one or more golf clubs). The apparatus, methods, and articles of manufacture described herein are not limited in this regard.

The golf bag 100 may further include a handle portion 300 coupled to the perimeter portion 210 of the club divider portion 200. In one example, the handle portion 300 may be a separate piece coupled to the club divider portion 200 via various manufacturing methods or processes (e.g., adhered with epoxy, fastened with screws, nuts, or bolts, any combination thereof, or other suitable methods or processes). In another example, the handle portion 300 and the club divider portion 200 may be a unitary piece (e.g., the handle portion 300 may be an integral piece of the club divider portion 200). The handle portion 300 may be coupled at one end to the first side 212 of the perimeter portion 210, extend outward and around a part of the perimeter portion 210, and coupled at another end to the second side 214 of the perimeter portion 210. Accordingly, the handle portion 300 may extend outside of the perimeter portion 210 and may be spaced apart from the perimeter portion 210 to define a handle opening 310. In use, an individual may insert his or her hand through the handle opening 310 and then wrap his or her fingers around the handle portion 300 to use the handle portion 300 to lift and/or carry the golf bag 100. In some examples, the handle portion 300 may include texturing to assist with grip. The apparatus, methods, and articles of manufacture described herein are not limited in this regard.

The handle portion 300 may include a club fastener portion 320 configured to engage a first shaft portion 410 of the golf club 400. The club fastener portion 320 may be located at or proximate to either the first side 212 or the second side 214 of the perimeter portion 210. The golf bag 100 may include a base portion 180 located at or proximate to the bottom portion 130 and configured to engage a second shaft portion 420 of the golf club 400. Accordingly, the club fastener portion 320 and the base portion 180 may engage the golf club 400 at two spaced apart portions (e.g., the first shaft portion 410 and the second shaft portion 420) to fasten or hold the golf club 400 in an inverted position. In one example, as shown in FIG. 1, the base portion 180 may be a pocket configured to receive therein the second shaft portion 420 of the golf club 400. In another example (not shown), the base portion 180 may be a sleeve portion, a tube portion, a platform portion, a cup-shaped portion, a channel portion, or any receptacle structure configured to receive and hold the second shaft portion 420 of the golf club 400. The club fastener portion 320 and the base portion 180 may define the second housing portion 150 for housing one or more golf clubs. In the example of FIG. 1, the second housing portion 150 is shown to house one golf club 400. The second housing portion 150 may separate and externally store and/or display a single golf club of a set of golf clubs stored in the first housing portion 140. In one example, the second housing portion 150 may hold a putter-type golf club. In another example (not shown), the second housing portion 150 may include multiple club fastener portions (not shown) that cooperate with the base portion 180 or several base portions (not shown) to house more than one golf club. Alternatively, the base portion 180 may include one or more rib portions to provide two or more separate openings, channels, chambers, or compartments. The apparatus, methods, and articles of manufacture described herein are not limited in this regard.

As described herein, the first housing portion 140 may define the chamber portion 142 and/or other interior space of the golf bag 100 to hold one or more golf clubs. The first housing portion 140 may extend between the top portion 120 and the bottom portion 130 or from the top portion 120 to the bottom portion 130. Further, the first housing portion 140 may have a length 500 that is greater than a percentage of a length of one or more golf clubs contained by the first housing portion 140. In the example of FIG. 1, the length 500 of the first housing portion 140 may include a height thereof or other dimension. For example, the length 500 of the first housing portion 140 may be greater than 50% of a maximum club length 510 of the golf club 144. In another example, the length 500 of the first housing portion 140 may be greater than 60% of the maximum club length 510 of the golf club 144. In yet another example, the length 500 of the first housing portion 140 may be greater than 70% of the maximum club length 510 of the golf club 144. In yet another example still, the length 500 of the first housing portion 140 may be greater than 80% of the maximum club length 510 of the golf club 144. Accordingly, the chamber portion 142 may be an elongated and substantially enclosed hollow internal space of the golf bag 100 for surrounding more than 50% of the club length of one or more golf clubs. When a golf club is received in the first housing portion 140, the golf club may have an exposed club length (e.g., club length 520 of golf club 144) that extends above the top portion 120. The exposed club length 520 of the golf club 144 may include a golf club head and a shaft portion of the golf club 144. During play, an individual can view the exposed club length 520 of the golf club 144 including at least the golf club head to visually differentiate the golf club from any other golf club(s) contained by the first housing portion 140. The apparatus, methods, and articles of manufacture described herein are not limited in this regard.

The second housing portion 150 has a length that may be defined by a length 530 of the club fastener portion 320 and a length 540 of the base portion 180. In the example of FIG. 1, the length 530 of the club fastener portion 320 and the length 540 of the base portion 180 may include a height thereof or other dimension. The length of the second housing portion 150 may be less than or equal to a percentage of a maximum club length of one or more golf clubs housed by the second housing portion 150. For example, the length of the second housing portion 150 may be less than or equal to 50% of a maximum club length 550 of the golf club 400. In another example, the length of the second housing portion 150 may be less than or equal to 60% of the maximum club length 550 of the golf club 400. In yet another example, the length of the second housing portion 150 may be less than or equal to 70% of the maximum club length 550 of the golf club 400. In yet another example still, the length of the second housing portion 150 may be less than or equal to 80% of the maximum club length 550 of the golf club 400. While the above examples may describe particular percentages, the apparatus, methods, and articles of manufacture described herein may include the second housing portion 150 having a length to engage a greater percentage or a lesser percentage of the maximum club length 550 of the golf club 400. Accordingly, when the golf club 400 is stored or held in the second housing portion 150, a portion of the maximum club length 550 of the golf club 400 may be exposed. More specifically, a portion of the golf club 400 other than the first shaft portion 410 and the second shaft portion 420 of the golf club 400 may be exposed. Thus, for a particular golf club, more than 50% of its maximum club length may be housed by the first housing portion 140, and less than or equal to 50% of its maximum club length may be housed by the second housing portion 150. As a result, the golf club 144 housed by the first housing portion 140 may have less exposed parts than the golf club 400 housed by the second housing portion 150. Advantageously, by having more exposed parts, the golf club 400 secured by the second housing portion 150 may be more prominently displayed than the golf club 144 stored in the first housing portion 140. Additionally, the golf club 400 may be easily handled due to more areas in which to grab the golf club 400 and remove the same from the second housing portion 150. What's more, the second housing portion 150 may be located frontward on the golf bag 100 such that the golf club 400 is readily accessible during play when the golf bag 100 is secured to a golf cart or placed on the ground. Accordingly, an individual may elect to use the second housing portion 150 to secure his or her most widely used golf club and/or to prominently display his or her favorite golf club. The foregoing features are not available in present golf bags. The apparatus, methods, and articles of manufacture described herein are not limited in this regard.

Figure 3:
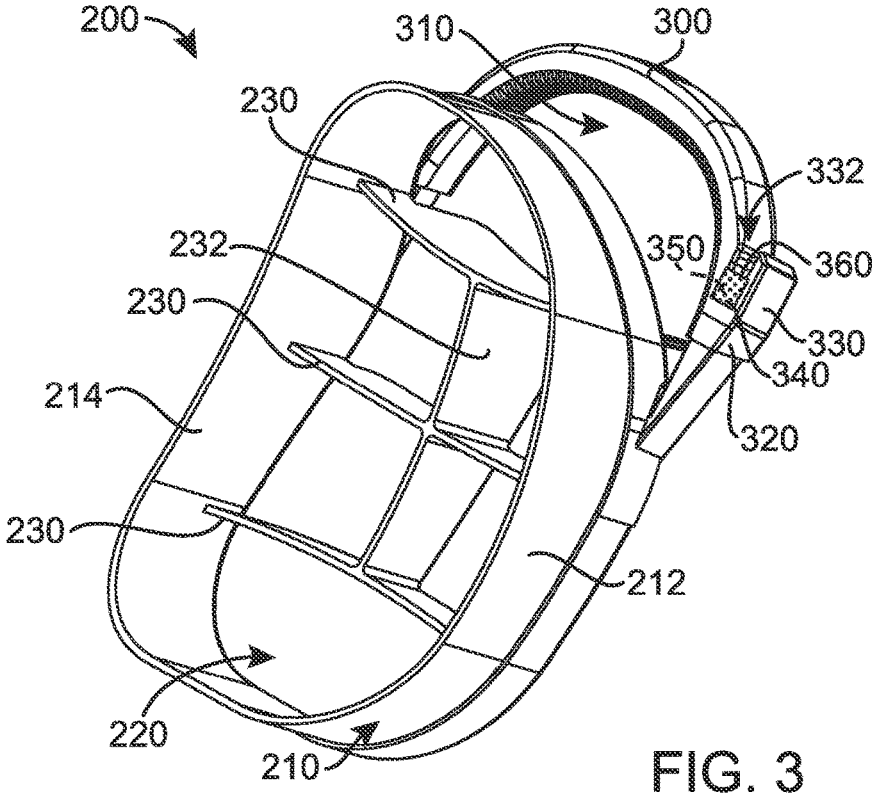
FIG. 3 depicts a bottom and side perspective view of the golf bag top of FIG. 2.
Figure 4:
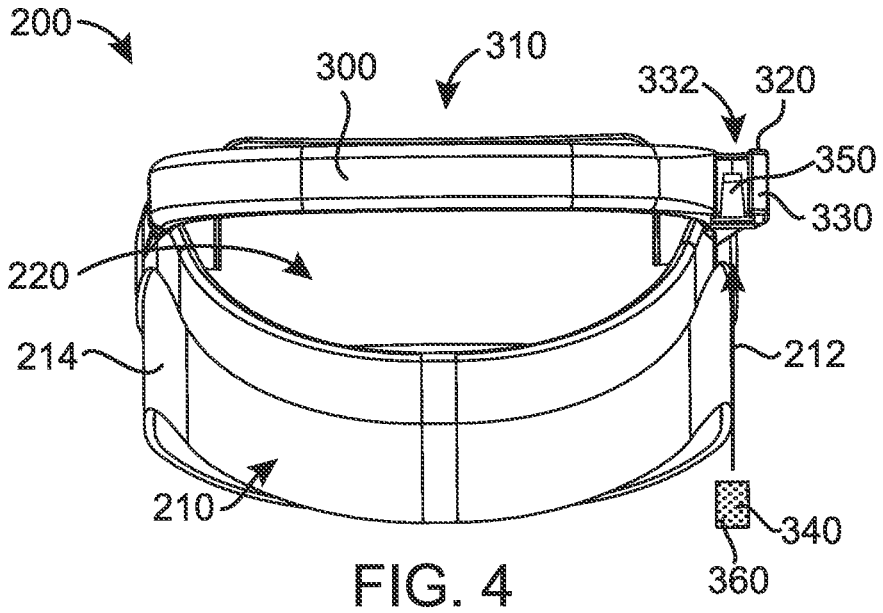
FIG. 4 depicts a front perspective view of the golf bag top of FIG. 2.
Figure 5:
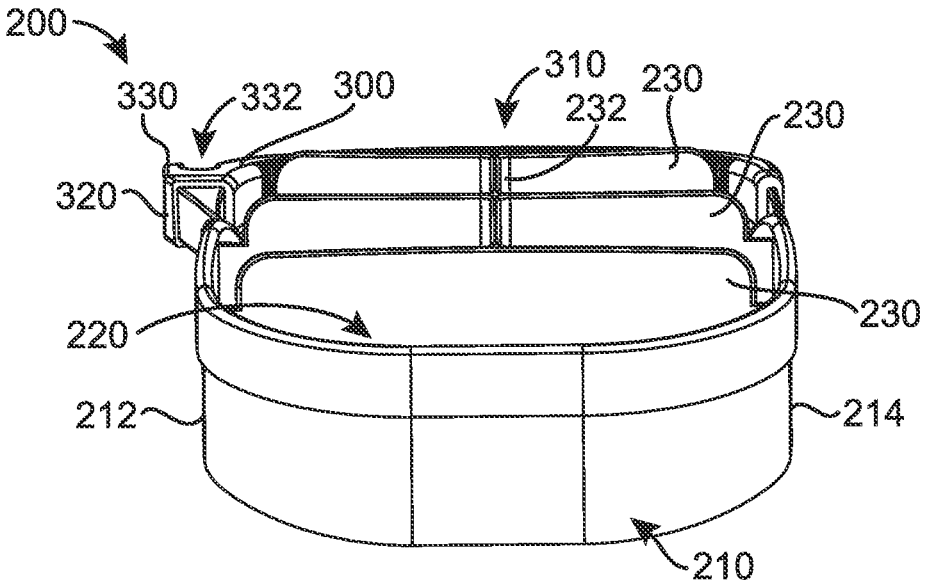
FIG. 5 depicts a back perspective view of the golf bag top of FIG. 2.
Figure 6:
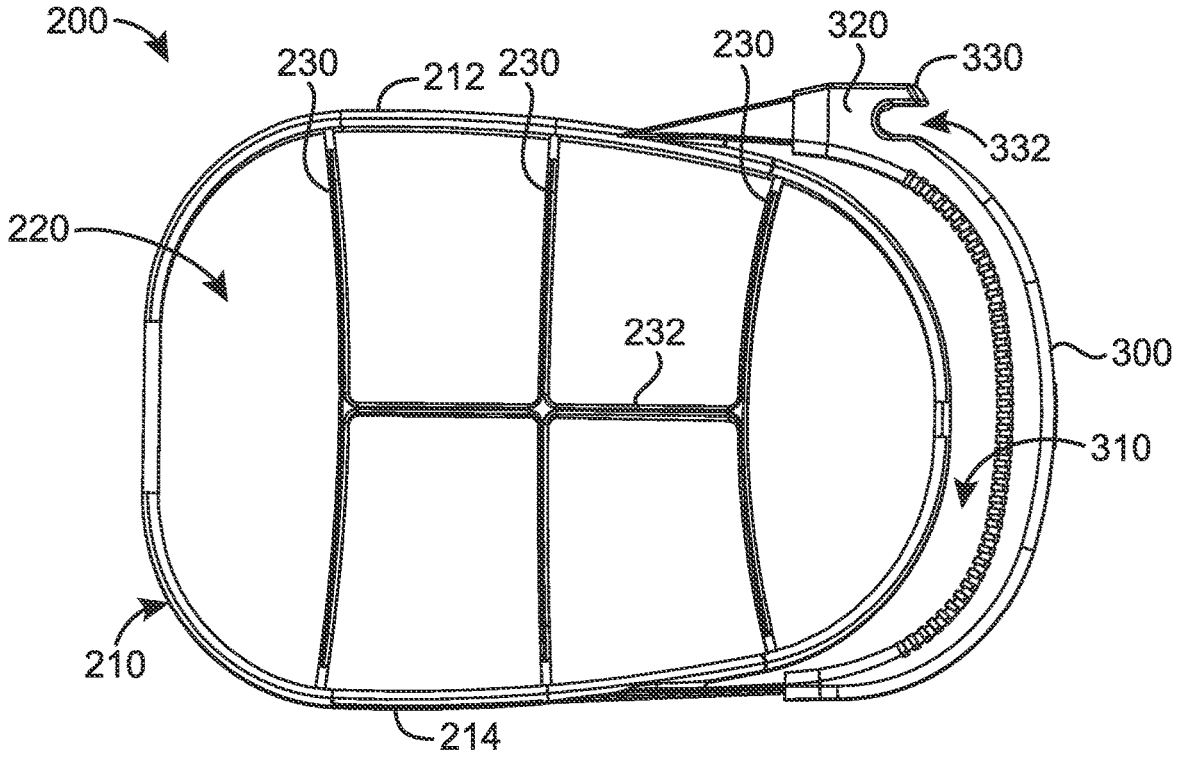
FIG. 6 depicts a top perspective view of the golf bag top of FIG. 2.
Figure 7:
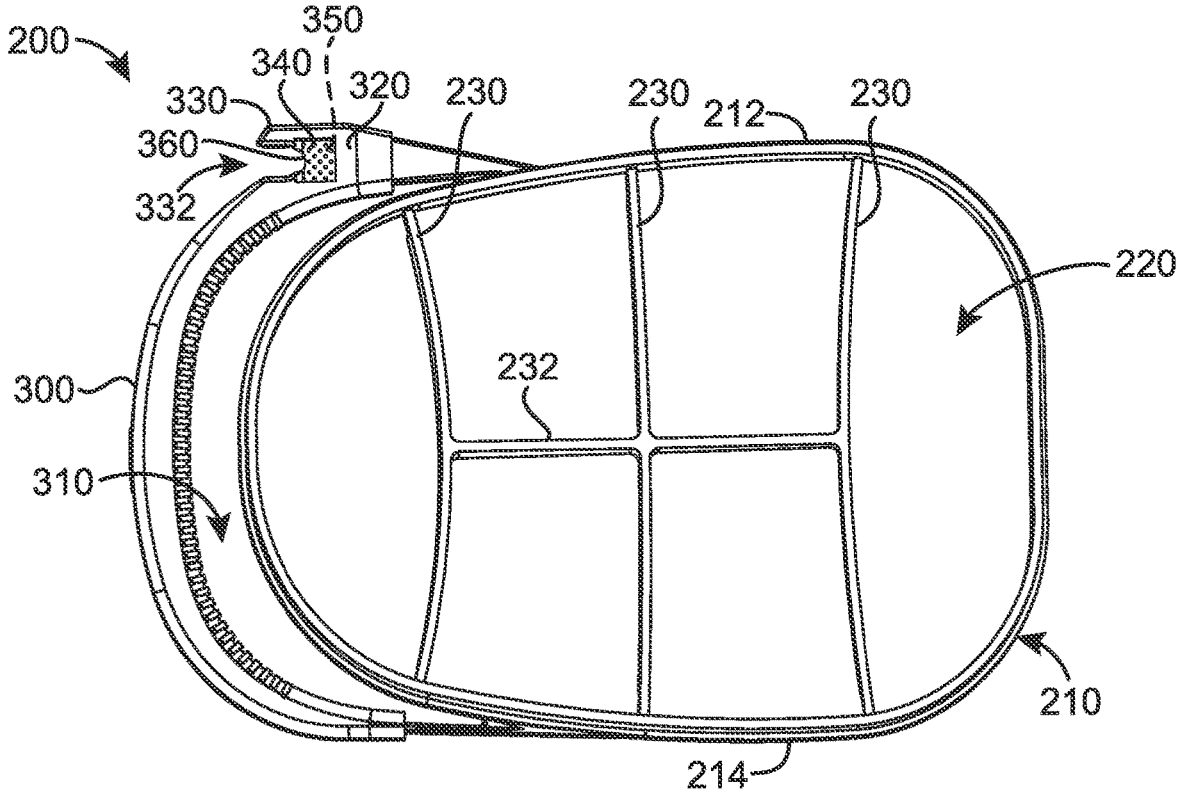
FIG. 7 depicts a bottom perspective view of the golf bag top of FIG. 2.
Figure 8:
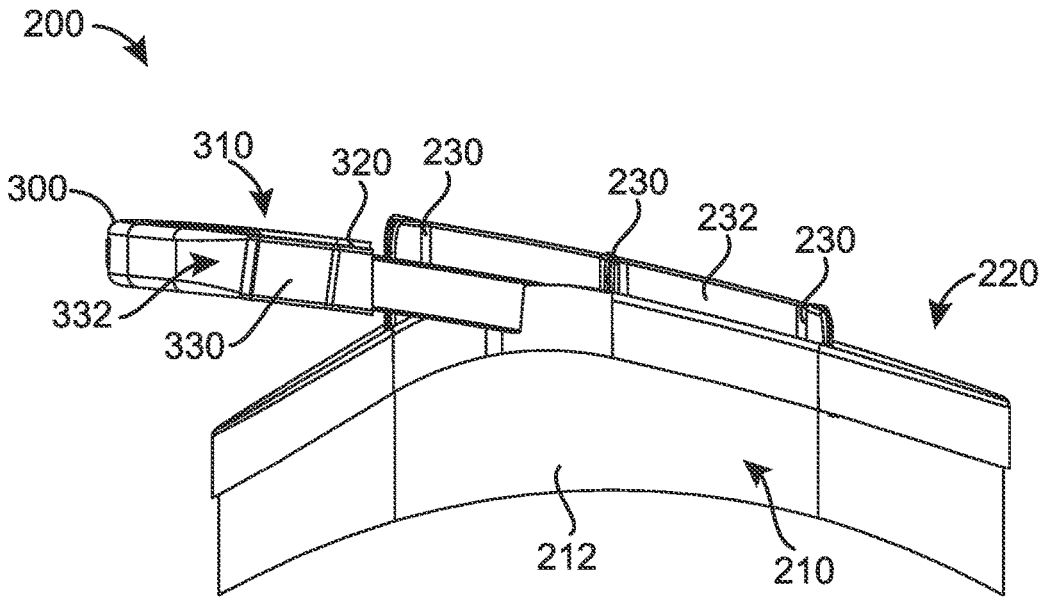
FIG. 8 depicts a side perspective view of the golf bag top of FIG. 2.
Figure 9:
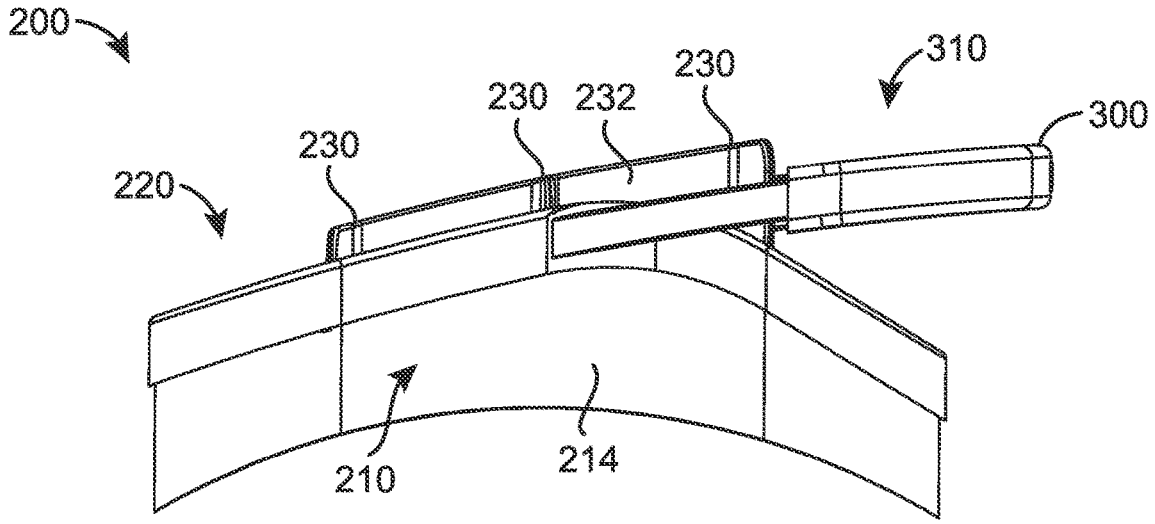
FIG. 9 depicts a side perspective view of the golf bag top of FIG. 2 showing an opposing side view of the golf bag top of FIG. 8.

The club fastener portion 320 may include any type of fastening mechanism configured to engage and hold a shaft 440 of the golf club 400 (e.g., via the first shaft portion 410). For example, the fastening mechanism may be a clamp or claw. In the example shown in FIGS. 1-9, the club fastener portion 320 may include a U-shaped portion 330 defining a space 332 with a width that is greater than or equal to a maximum outer diameter of the shaft 440 of the golf club 400. In one example, the maximum outer diameter of the shaft 440 at or proximate to a grip portion 455 (e.g., butt end of the shaft 440) may be in a range of 0.58 inch to 0.64 inch. The maximum outer diameter of the shaft 440 at or proximate to the club head of the golf club 400 (e.g., tip end of the shaft 400) may be in a range 0.335 inch to 0.37 inch. While the above examples may describe particular outer diameters, the apparatus, methods, and articles of manufacture described herein may include shafts with greater or smaller diameters. Accordingly, the first shaft portion 410 or other shaft portion of the golf club 400 may be inserted into the U-shaped portion 330. To hold the first shaft portion 410 of the golf club 400 in the U-shaped portion 330, the club fastener portion 320 may include a magnetic portion 340 inside the U-shaped portion 330. Accordingly, the first shaft portion 410 or other shaft portion of the golf club 400 may engage the magnetic portion 340 to secure the golf club 400 to the U-shaped portion 330. Referring to FIGS. 3, 4, and 7, for example, the magnetic portion 340 may be placed inside a cavity 350 on the underside of the club fastener portion 320. The cavity 350 may be open to the space 332 defined by the U-shaped portion 330 such that a portion 360 of the magnetic portion 340 is exposed to the space 332 and is free to interface with the first shaft portion 410 of the golf club 400. The magnetic portion 340 may be sized and shaped to complement the cavity 350 so as to allow the magnetic portion 340 to be easily received inside the cavity 350 and secured thereto via friction and/or adhesives. In other examples, the magnetic portion 340 may have a circular cross section, a square cross section, a rectangular cross section, or any other suitable shape to engage the shaft 440 of the golf club 400. While the above examples may describe the magnetic portion 340 as a separate piece, the magnetic portion 340 may be an integral portion of the club fastener portion 320. In one example, the club fastener portion 320 may be made of or include material(s) with magnetic properties to engage and secure a shaft of the golf club 400 (i.e., the shaft may be made of metal material(s)). Alternatively, the club fastener portion 320 may include the U-shaped portion without the magnetic portion 340 and engage the shaft 440 of the golf club 400 with a mechanical lock only. Further, while the figures may depict the club fastener portion 320 as a portion of the handle portion 300, the club fastener portion 320 may extend directly from the club divider portion 200 (e.g., extend from the perimeter portion 210). The apparatus, methods, and articles of manufacture described herein are not limited in this regard.

An individual may easily store and retrieve a golf club from the second housing portion 150. For example, the second shaft portion 420 of the golf club 400 may be inserted into the base portion 180 and then the golf club 400 may be guided toward the club fastener portion 320 so that the first shaft portion 410 of the golf club 400 is received in the U-shaped portion 330 and held in place by the magnetic portion 340. To remove the golf club 400 from the second housing portion 150, the golf club 400 may be pulled away from the club fastener portion 320 with sufficient force to disengage the first shaft portion 410 of the golf club 400 from the magnetic portion 340. The second shaft portion 420 may be removed from the base portion 180 by lifting the golf club 400 in an upward direction. As described herein, the handle portion 300 extends outward and around a part of the perimeter portion 210. Accordingly, the outward location of the handle portion 300 relative to the top portion 120 of the body portion 110 separately locates the golf club 400 from other golf clubs and allows for easy access and use by the individual. In one example, the second housing portion 150 may be used to separate a putter-type golf club from the iron-type golf club(s), the wood-type golf club(s), the hybrid-type golf club(s), or the wedge-type golf club(s) stored in the first housing portion 140. The apparatus, methods, and articles of manufacture described herein are not limited in this regard.

In one example, as shown in FIG. 1, the base portion 180 may include an external pocket 182 of the golf bag 100. The external pocket 182 may be located at or near the bottom portion 130. The external pocket 182 may include an opening 184, through which the second shaft portion 420 or other portion of the golf club 400 may be inserted. The opening 184 may be freely accessible or accessed via a closure (e.g., zipper, Velcro®, button, etc.). In one example, as shown in FIG. 1, the club fastener portion 320 may engage the first shaft portion 410 of the golf club 400, which may be a portion of the shaft 440 of the golf club 400 that is closer to a golf club head 450 than to the grip portion 455 of the golf club 400. The external pocket 182 may receive the second shaft portion 420 of the golf club 400, which may be a portion of the shaft 440 of the golf club 400 that includes the grip portion 455. In one example, as shown in FIG. 1, the length 540 of the base portion 180 may be greater than or equal to a maximum length 560 of the grip portion 455 of the golf club 400. For example, the maximum length 560 of the grip portion 455 may be 10 inches. Although the above example may describe a particular length of the grip portion 455, the apparatus, methods, and articles of manufacture described herein may include grip portions with greater or shorter lengths. Additionally, the length 540 of the base portion 180 may be less than or equal to 50% of the maximum club length 550 of the golf club 400. In another example (not shown), the length 540 of the base portion 180 may be less than the maximum length 560 of the grip portion 455 of the golf club 400. In one example, the particular length 540 of the base portion 180 may be determined based on an individual's desire to shield the grip portion 455 or to prominently display the grip portion 455. The apparatus, methods, and articles of manufacture described herein are not limited in this regard.

The maximum club length 550 of the golf club 400 may vary based on the type of golf club and/or an individual's preference (e.g., in the range of 30 inches to 60 inches). In one example, the maximum club length 550 of a driver-type golf club may be in a range of 45 inches to 60 inches. In another example, the maximum club length 550 of a fairway wood-type golf club may be about 44 inches. In yet another example, the maximum club length 550 of a hybrid-type golf club may be in a range of 42 inches to 44 inches. The maximum club length 550 of an iron-type golf club may be in a range of 36 inches to 41 inches. The maximum club length 550 of a wedge-type golf club may be in a range of 35 inches to 37 inches. The maximum club length 550 of a putter-type golf club may be in a range of 32 inches to 36 inches. In one example, the maximum club length 550 of the golf club 400 may be limited by a governing body of golf such as, but not limited to, the United States Golf Association (USGA). At present, the USGA requires the club length of a golf club to be at least 18 inches and, with the exception of putters, no more than 48 inches. With respect to the present disclosure, the "maximum club length" of a particular club may correspond to a straight-line measurement taken down the shaft beginning from the top of the grip portion to where the golf club meets the ground while the golf club is soled at an address position. While the above examples may describe particular lengths of certain types of golf clubs, the apparatus, methods, and articles of manufacture described herein may include golf clubs with greater or shorter club lengths. The apparatus, methods, and articles of manufacture described herein are not limited in this regard.

In one example, as shown in FIG. 1, the base portion 180 may be located more outward from the club fastener portion 320. In other words, the base portion 180 may be horizontally offset relative to the club fastener portion 320. Further, the pocket 182 of the base portion 180 and the U-shaped portion 330 of the club fastener portion 320 may be generally located on the same vertical plane or substantially on the same vertical plane. In this way, the golf club 400 may be held in an upright position with a slight tilt toward the first housing portion 140. In another example (not shown), the base portion 180 and the club fastener portion 320 may be aligned to have no horizontal offset therebetween such that the golf club 400 may be held in an upright orientation with no tilt. When the grip portion 455 of the golf club 400 is inserted into the pocket 182 and then the first shaft portion 410 of the golf club 400 is moved toward the magnetic portion 240, the pocket 182 may guide the shaft 440 of the golf club 400 toward the U-shaped portion 330 with minimal or no lateral pivot. In other words, the second shaft portion 420 that is engaged inside the pocket 182 may be encouraged to move inside the pocket 182 toward the U-shaped portion 330 while the pocket 182 prevents or substantially prevents any lateral pivot of the golf club 400. Additionally, the golf club 400 may have a tendency to pivot toward the magnetic portion 340 due to the noted horizontal offset between the pocket 182 and the club fastener portion 320. Accordingly, when an individual inserts the second shaft portion 420 of the golf club 400 into the pocket 182, the golf club 400 may pivot toward the club fastener portion 320, enter the U-shaped portion 330, and engage the magnetic portion 340 with minimal or no effort from the individual. The apparatus, methods, and articles of manufacture described herein are not limited in this regard.

In one example, the golf bag 100 may be manufactured by known manufacturing methods and materials used for manufacturing golf bags. For example, the golf bag 100 may include a rigid frame or shell that may be covered in soft materials such as leather, canvas, plastic, metal, composite materials, and/or other materials. The golf bag 100 may include any number of rings, clips, clamps, etc., to allow attachment of various straps and/or accessories. The golf bag 100 may include one or more pockets. The base portion 180 may be configured (i.e., sized, shaped, etc.) to engage the second shaft portion 420 of the golf club 400 and positioned to be aligned (e.g., vertical planar alignment) with the U-shaped portion 330 as described herein. The base portion 180 may include elastic materials or be generally elastic to grip the second shaft portion 420 of the golf club 400. The apparatus, methods, and articles of manufacture described herein are not limited in this regard.

In one example, all or portions of the divider portion 200 may be manufactured from rigid plastic materials by injection molding. For example, the perimeter portion 210, the rib portions 230, and the spine portion 232 may be co-manufactured by injection molding. In another example, the rib portions 230 and the spine portion 232 may be separately manufactured and attached to the perimeter portion 210. In one example, the handle portion 300 may be separately manufactured by injection molding or other plastic manufacturing methods and attached to the perimeter portion 210. As described herein, the magnetic portion 340 may be attached inside the cavity 350 of club fastener portion 320 by way of friction and/or an adhesive. The divider portion 200 may be manufactured from any type of plastic materials, metals, metal alloys, composite materials, wood, and/or any other material. In one example, the divider portion 200 may be attached to the body portion 110 of the golf bag 100 by rivets. In another example, the divider portion 200 may be attached to the body portion 110 of the golf bag 100 by nuts and bolts. In yet another example, the divider portion 200 may be attached to the body portion 110 of the golf bag 100 by screws. In yet another example still, the divider portion 200 may be attached to the body portion 110 of the golf bag 100 by being surrounded by rigid portions of the body portion 110 of the golf bag 100. The apparatus, methods, and articles of manufacture described herein are not limited in this regard.

The golf bag top or the divider portion 200 may be used for any type of golf bag and may not be limited for use with any of the golf bags described herein. The divider portion 200 may be manufactured to fit any type and size of golf bag. The golf bag top or the divider portion 200 may then be attached at or near the top portion of a golf bag to provide the functions discussed herein in combination with one more pockets (i.e., base portion) of the golf bag at or near the bottom portion of the golf bag. The apparatus, methods, and articles of manufacture described herein are not limited in this regard.

Although a particular order of actions may be described herein with respect to one or more processes, these actions may be performed in other temporal sequences. Further, two or more actions in any of the processes described herein may be performed sequentially, concurrently, or simultaneously.

A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf bag comprising:

a body portion including a top portion, a bottom portion, and a housing portion extending between the top portion and the bottom portion;

a club divider portion located at or proximate the top portion, the club divider portion comprising:

a perimeter portion having one or more interior walls;

one or more rib portions connected to the perimeter portion to define one or more openings configured to allow one or more golf clubs to be received in the housing portion through the one or more openings;

a handle portion coupled to the perimeter portion, a portion of the handle portion comprising a club fastener portion, the club fastener portion comprising:

a U-shaped portion defining a space;

a cavity adjacent the U-shaped portion; and a magnetic portion disposed inside the cavity, wherein the magnetic portion is received inside the cavity via an opening at an underside of the handle portion, wherein the cavity is open to the space, wherein the magnetic portion is exposed to the space, and wherein the magnetic portion is configured to magnetically attract a metal shaft portion of a golf club received in the space of the U-shaped portion.

2. A golf bag as defined in claim 1, wherein the U-shaped portion has a width greater than or equal to an outer diameter of the metal shaft portion of the golf club.

3. A golf bag as defined in claim 1, wherein the handle portion extends outward and around a part of the perimeter portion.

4. A golf bag as defined in claim 1, wherein the magnetic portion is adhered to the cavity.

5. A golf bag as defined in claim 1, wherein the magnetic portion is frictionally coupled to the cavity.

6. A golf bag as defined in claim 1, further comprising an external pocket located at or proximate the bottom portion, the external pocket configured to at least partially receive a grip portion of the golf club.

7. A golf bag comprising:

a body portion comprising a top portion, a bottom portion, and a housing portion extending between the top portion and the bottom portion, the housing portion configured to receive a plurality of golf clubs;

a handle portion located at or proximate the top portion, the handle portion comprising:

a club fastener portion configured to receive a metal shaft portion of a golf club;

a cavity in an underside of the handle portion; and a magnetic portion received inside the cavity via the underside of the handle portion, wherein the magnetic portion is configured to magnetically attract the metal shaft portion to secure the golf club to the club fastener portion.

8. A golf bag as defined in claim 7, wherein the magnetic portion is exposed to the metal shaft portion.

9. A golf bag as defined in claim 7, wherein the magnetic portion is frictionally coupled to the cavity.

10. A golf bag as defined in claim 7, wherein the magnetic portion is adhered to the cavity.

11. A golf bag as defined in claim 7, wherein the club fastener portion secures the golf club externally from the housing portion.

12. A golf bag as defined in claim 7, further comprising an external pocket located at or proximate the bottom portion, the external pocket configured to at least partially receive a grip portion of the golf club.

13. A golf bag comprising:

a body portion comprising a top portion, a bottom portion, and a housing portion extending between the top portion and the bottom portion, the housing portion configured to receive a plurality of golf clubs;

a handle portion located at or proximate the top portion; and a club fastener portion integral to the handle portion, the club fastener portion having a U-shaped portion configured to receive a shaft portion of a golf club and retain the golf club in an upright position or tilted position such that a golf club head of the golf club is positioned above the club fastener portion and a grip portion of the golf club is positioned below the club fastener portion.

14. A golf bag as defined in claim 13, wherein the club fastener portion is configured to retain the golf club via magnetic attraction.

15. A golf bag as defined in claim 13, wherein the U-shaped portion retains the golf club externally from the housing portion.

16. A golf bag as defined in claim 13, the club fastener portion further comprising a cavity and a magnetic portion disposed in the cavity.

17. A golf bag as defined in claim 16, wherein at least a portion of the magnetic portion is exposed.

18. A golf bag as defined in claim 13, further comprising an external pocket located below the club fastener portion, the external pocket configured to at least partially receive the grip portion of the golf club.

19. A golf bag as defined in claim 13, wherein the club fastener portion and the shaft portion are engaged by a mechanical lock.

20. A golf bag as defined in claim 1, wherein the handle portion is coupled at one end to a first side of the perimeter portion and at another end to a second side of the perimeter portion, and wherein the club fastener portion is located at or proximate either the first side or the second side of the perimeter portion.

* * * * *